US006030908A

United States Patent [19]

Baker et al.

[11] Patent Number: 6,030,908

[45] Date of Patent: Feb. 29, 2000

[54] MULTILAYER POROUS FABRIC

[75] Inventors: Samuel M. Baker, Carleton Place, Canada; Eugene Z. Fekete, Dunwoody, Ga.; Graham W. Jackson, Carleton Place; Kurt Wiebe, North Gower, both of Canada

[73] Assignee: JWI Ltd., Canada

[21] Appl. No.: 09/039,328

[22] Filed: Mar. 16, 1998

[51] Int. Cl.[7] ..... B32B 5/06; D03D 23/00

[52] U.S. Cl. ..... 442/402; 442/271; 442/383; 139/383 R; 162/900

[58] Field of Search ..... 442/402, 76, 271, 442/383, 270; 139/383 R; 162/900, 358.1; 28/106

[56] References Cited

U.S. PATENT DOCUMENTS

| | | | |
|---|---|---|---|
| 2,717,437 | 9/1955 | Mestral . | |
| 3,009,235 | 11/1961 | Mestral . | |
| 3,943,981 | 3/1976 | De Brabander . | |
| 4,356,225 | 10/1982 | Dufour . | |
| 4,357,386 | 11/1982 | Luciano . | |
| 4,414,263 | 11/1983 | Miller . | |
| 4,759,975 | 7/1988 | Sutherland . | |
| 4,867,206 | 9/1989 | Kufferath . | |
| 5,053,109 | 10/1991 | Penven | 162/348 |
| 5,089,324 | 2/1992 | Jackson . | |
| 5,194,121 | 3/1993 | Taguchi et al. | 162/900 X |
| 5,268,076 | 12/1993 | Best . | |
| 5,277,967 | 1/1994 | Zehle . | |
| 5,360,656 | 11/1994 | Rexfelt . | |
| 5,601,691 | 2/1997 | Kufferath . | |
| 5,891,547 | 4/1999 | Lawless | 442/402 X |
| 5,945,357 | 8/1999 | Quigley | 162/900 X |

FOREIGN PATENT DOCUMENTS

WO93/01350 of 1993 WIPO .

*Primary Examiner*—Daniel Zirker
*Attorney, Agent, or Firm*—Robert A. Wilkes

[57] ABSTRACT

A multilayer porous fabric which comprises a porous core fabric provided with hook means, and at least one layer of pre-needled nonwoven fibrous batt attached by entanglement onto the hook means by pressing the core fabric and batt together. The entanglement is sufficient to anchor the batt reliably to the core fabric, so that the multilayer fabric is ready for use without further processing. The porous core fabric may be formed by weaving or as an extruded sheet, with a plurality of suitably located hook means structures on at least one of its surfaces. The hook structures engage with and entangle sufficient fibers from the pre-needled nonwoven batt to provide adequate attachment preventing the batt from separating from the core fabric enabling the multilayer fabric to be handled before use, for example for installation in a papermaking machine press section. The batt is pre-needled to a desired density before attachment to the core fabric. In many circumstances, compressive loads applied to the porous fabric serve to enhance and improve the level of entanglement of the batt onto the hook means.

14 Claims, 3 Drawing Sheets

MULTILAYER POROUS FABRIC

FIELD OF THE INVENTION

The present invention relates to porous fabrics. It is particularly concerned with multilayer porous fabrics comprising a core fabric to which a pre-needled nonwoven fibrous batt is attached on one, or both, sides. The invention seeks to provide a multilayer porous fabric that does not require a needling step as part of the assembly process. However, the or each batt layer will be pre-needled to a desired density before assembly of the fabric. These multilayer porous fabrics typically are of use in the press section of a papermaking machine.

BACKGROUND OF THE INVENTION

In a paper making machine, fabrics are used in each of the forming, pressing, and dryer sections to support the paper web as it is made. In the forming section the stock is deposited onto a moving forming fabric, or between two opposed forming fabrics, to provide a very wet paper web. In the press section, the very wet paper web is carried by at least one press fabric, and subjected to compression in a nip between at least one pair of press section rolls to remove further water from the wet paper web. In the dryer section, the wet paper web is carried by at least one dryer fabric and subjected to heat to remove the remaining water down to a desired level of dryness. The finished paper can then be calendered, and wound onto rolls. In each of these sections, the fabric used, in addition to being subjected to the longitudinal stresses required to keep it reasonably tight and to move it at the desired speed, is also exposed to the conditions prevailing within that section of the papermaking machine. Since the conditions of use in each of these sections are so radically different, fabrics are designed and engineered for each of these sections separately.

The present invention is particularly concerned with multi-layer porous fabrics suitable for use as press section fabrics, although this form of multilayer porous fabric is of more general applicability elsewhere.

The paper web entering the press section will typically contain as much as 85% water. In the press section, much of this water is removed by passing the paper web in contact with one or more press fabrics through at least one nip between at least one pair of opposed press rolls, which applies a significant pressure to the web paper web carried by the press fabric. As the wet paper web is squeezed in the nip, water is transferred from the wet paper web into the press fabrics, and is subsequently removed from the press fabrics by various means. It has become standard practice to use press fabrics having a multi-layer structure, comprising a porous core fabric carrying a layer of nonwoven fibrous batt attached by needle punching to one, or to both, of its sides. The core fabric may be woven or nonwoven. Typical known core fabrics are described by Miller et al in U.S. Pat. No. 4,414,263; by Dufour in U.S. Pat. No. 4,356,225; by Luciano et al in U.S. Pat. No. 4,357,386; by Sutherland et al. in U.S. Pat. No. 4,759,975; by Zehle et al in U.S. Pat. No. 5,277,967, and by Kufferath in U.S. Pat. No. 5,601,691. Many other fabric designs have also been both proposed and used.

The nonwoven fibrous batt part of the press fabric serves various functions. It increases the water carrying capacity of the fabric so as to enable it to transport the maximum amount of water away from the wet paper web. It also serves to reduce any tendency of the core fabric to impart a mark on the wet paper web caused by non-uniform transfer of the compressive loads in a press roll nip.

The core fabric also serves several functions. It supports both the batt and the paper web through the press rolls so that water can be removed from the wet paper web. It also has to accommodate all of the mechanical stresses imposed on the press fabric, which include the required level of tension, and the force required to move the press fabric and the paper web through the press section at the required speed.

Further, a press fabric, comprising the combination of a core fabric and at least one layer of attached batt, must be able to resist the compressive loads imposed as it passes through the press roll nip, or nips, for an acceptable period of time without premature collapse, since collapse severely restricts water carrying capacity.

It can thus be seen that the mechanical properties of the core fabric are often directly related to the performance of a porous fabric of this type.

A disadvantage long associated with the production of many multilayer porous fabrics, which includes press fabrics, is that the method commonly used commercially for attaching one or more layers of nonwoven fibrous batts to one side, or to both sides, of the core fabric is by the needling process. In the needling process, a proportion of the batt fibers are forced into engagement with the core fabric essentially either by forcing these fibers through holes pierced in the fabric by the specially shaped needles, or by pushing a proportion of the batt fibers through the mesh of the fabric. This is a time consuming and costly operation, requiring expensive, specialized equipment. It also suffers from the disadvantages that only a small proportion of the batt fibers become entangled with the core fabric, and that a proportion of the batt fibers are damaged in the needling process. Further, in the needling process, which typically provides from about 500–1,500 needle penetrations per $cm^2$, the needles pierce holes right through the core fabric which result in an unpredictable level of damage to both the component yarns in a woven core fabric, and to the structure of the core fabric.

Needling can also create fabric defects which must be corrected, which increases production costs. For example, in preparing a press fabric, it is well known that a loop of monofilament, or a broken end of a monofilament, from the core fabric can be pushed out through the batt during needling. If the exposed monofilament is on the paper carrying surface of the press fabric this creates a surface defect which must be corrected as it will cause either marking of the paper, or even holes punctured through the paper. Further, the needles used in the needling loom break regularly. The broken needles have to be replaced, and the remnants of metal left in the fabric being needle punched must be removed. These necessary repairs to the fabric to remove defects, and maintenance of the needling equipment, thus reduce the overall efficiency of manufacture, which impacts significantly on production costs.

Although the needling process is effective in the sense that a useable press section fabric is obtained, it also involves an unknown level of damage to both the batt and the core fabric, which can deleteriously affect the potential useful life of the press fabric.

To overcome these difficulties, it has been proposed to employ a porous fabric without a batt needled thereto as a press fabric, for example as described by Jackson, in U.S. Pat. No. 5,089,324, and in WO93/01350, and by Kufferath in U.S. Pat. No. 4,867,206. Such proposals have met with limited success.

It is therefore desirable that a better option than the prior art needling process for attaching a pre-needled nonwoven fibrous batt to one, or both, of the surfaces of a core fabric should be available. The present invention seeks to provide a multilayer porous fabric which is constructed without using a needling step at all. In the multilayer porous fabrics of this invention a needling step is only used to ensure that the batt used in the applied layer, or layers, is of an acceptable density and internal level of entanglement. Since this needling step is carried out prior to attachment of the batt to the core fabric, the core fabric is not exposed to any damage.

SUMMARY OF THE INVENTION

The present invention seeks to provide a multilayer porous fabric comprising in combination a porous core fabric including a plurality of hook means on at least one of its surfaces, and at least one layer of a pre-needled non-woven fibrous batt, wherein at least some of the batt fibers are entangled onto the hook means by entangling the hook means.

Preferably, the porous core fabric is a woven, knitted or extruded fabric. Conveniently, the porous core fabric is a closed loop comprising a spiral wound strip, or strips, of suitable width.

Preferably, the core fabric is an extruded sheet, and includes a plurality of suitably located hook means on at least one of its two surfaces. Preferably, an extruded core fabric, in the form of a continuous sheet or strip, is made porous by mechanical perforation to provide a plurality of suitably shaped and located apertures in the extruded fabric. Desirably, the perforations are located in channels between the hook means.

Alternatively, the core fabric is woven or knitted, a plurality of suitably located hook means are provided during the weaving or knitting process, and the fabric pattern is chosen to provide the desired level of porosity. Many fabrics of this type have been described; typical examples are described by De Mestral in U.S. Pat. No. 2,717,437 and in U.S. Pat. No. 3,009,235; and by de Brabander in U.S. Pat. No. 3,943,981.

Preferably, the core fabric includes a plurality of hook means of sufficient size and shape whose locations are chosen so as to allow for sufficiently secure attachment of the batt. Conveniently, the hook means shape is chosen from shapes such as fish hook, mushroom, "Christmas tree", "palm tree" and other known shapes.

As used herein, the following terms have the following meanings.

A "core fabric" refers to a porous woven or nonwoven fabric to which a pre-needled nonwoven fibrous batt layer may be attached by entanglement with hook means on one or both sides.

A "pre-needled nonwoven fibrous batt" is a three dimensional agglomeration of fibers of specified size and material formed as a sheet that has been densified to the desired level by needling a plurality of layers of lightly entangled fibers together; the fibers used in the agglomeration need not be all the same size, and need not be all made from the same material.

A "hook means" is a shaped structure formed integrally with, or attached to, a core fabric by any suitable process, constructed and located to provide entanglement with the fibers of a pre-needled non-woven fibrous batt.

BRIEF DESCRIPTION OF THE DRAWINGS

The invention will now be described with reference to the attached drawings in which.

DETAILED DESCRIPTION OF THE INVENTION

Figure 1:
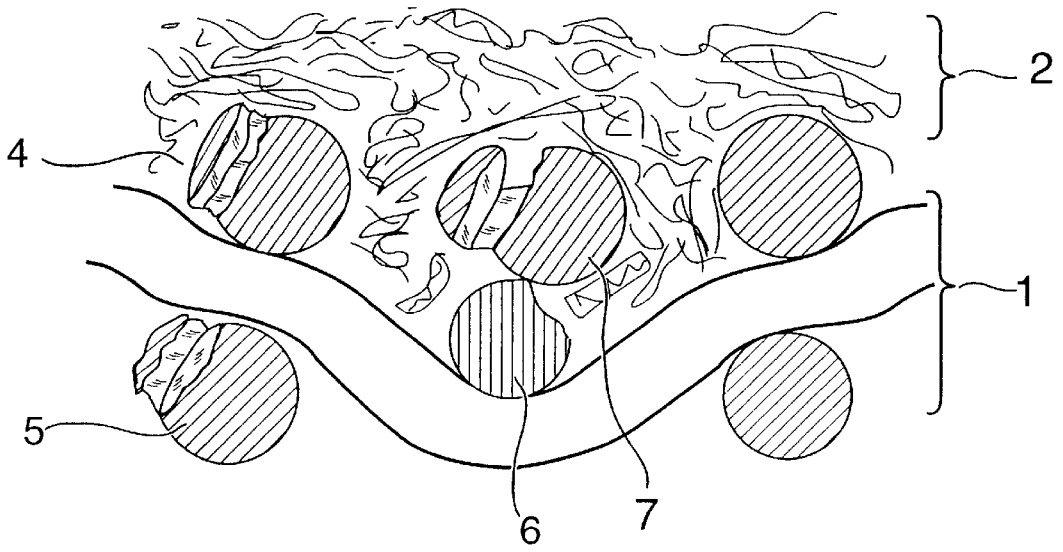
FIG. 1 shows a partly sectioned view of a typical prior art porous fabric including a layer of batt needled to a woven core fabric.

Referring first to FIG. 1, there is shown a schematic cross section diagram based on a cross section micrograph of a typical known porous fabric. This porous fabric comprises a core fabric 1 which has been woven from monofilament yarns to which has been attached a layer of non-woven batt 2. In this fabric, the batt has been attached by the conventional needle punching process. As can be seen particularly at 4, 5, 6 and 7 the yarns of core fabric 1 have been significantly damaged; yarns 4, 5, and 7 have been split, and material detached from the upper right side of yarn 7. But once the fabric is assembled by the needling process it is only possible to determine how much core fabric damage has happened by visual inspection of a fabric with only one layer of batt. For the far more common fabrics, for example typical press section fabrics, where two needle punched layers of batt are used, examination of the core fabric to determine the level of damage is simply not possible without tearing apart a hopefully representative sample of the multilayer fabric.

Figure 2:
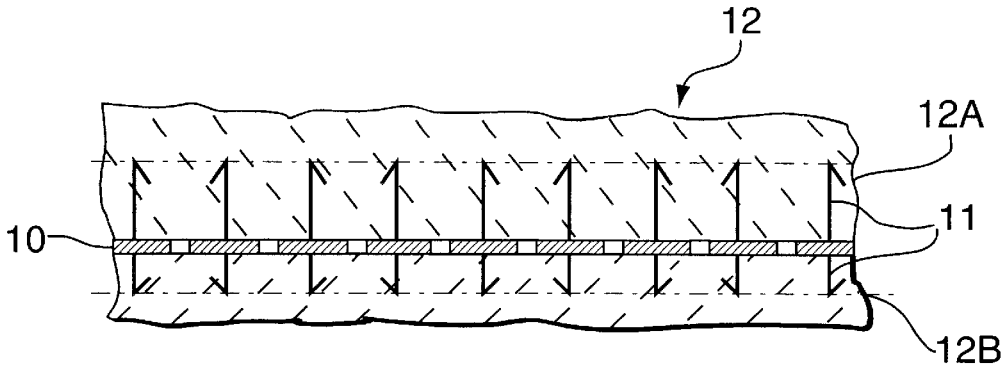
FIG. 2 shows one embodiment of a multilayer porous fabric.

The porous fabrics of this invention overcome this difficulty by eliminating the needle punching step altogether. As shown in FIG. 2, the porous fabrics of this invention comprise essentially three components:

(i) the porous core fabric 10 which supports the whole structure, (ii) the hook means 11 carried by the core fabric 10, and (iii) the pre-needled nonwoven fibrous batt layer or layers 12 attached to at least one side (12A), and often to both sides (12A and 12B), of the core fabric.

The core fabric 10 must be porous, so as to allow water carried by the multilayer fabric to be drained away from the fabric, for example, water pressed out of a wet paper web.

Figure 3:
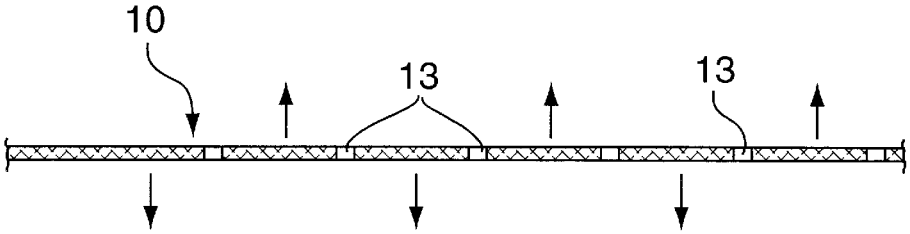
FIG. 3 shows an extruded core fabric with hooks on both sides.

If the core fabric 10 is an extruded sheet, as in FIGS. 2 and 3, the required porosity is obtained by perforating the sheet 10 to provide sufficient suitably shaped and located apertures 13 in the sheet. It is also desirable that damage to the hook means 11 carried by the core fabric 10 should be kept to a minimum in the perforation step. A simple way to achieve this is to locate the hook means 11 in rows, and to place the perforations 13 between the rows, as is shown in FIG. 3. The thickness and the thermoplastic material used for such an extruded sheet are also chosen to provide the required physical properties.

Figure 4:
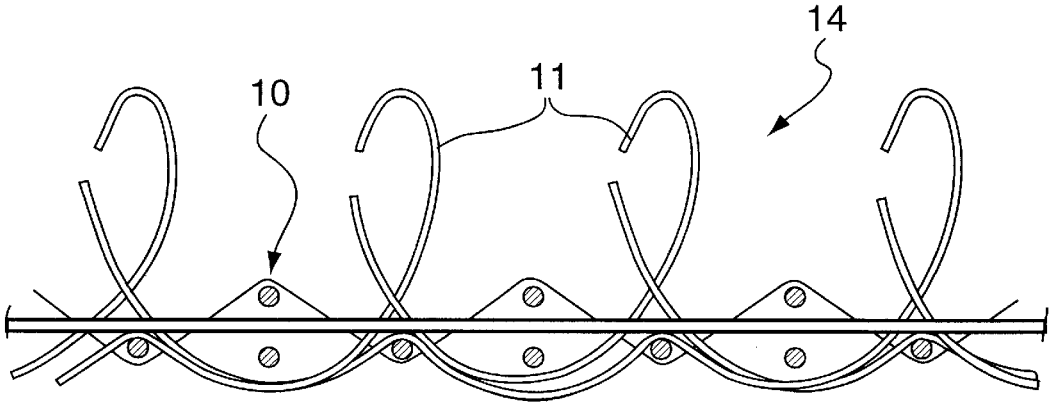
FIG. 4 shows a woven core fabric with hooks on one side.
Figure 5:
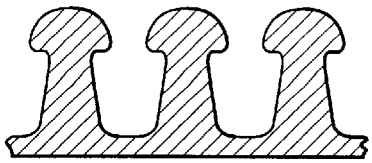
FIGS. 5–8 show different hook structures.
Figure 6:
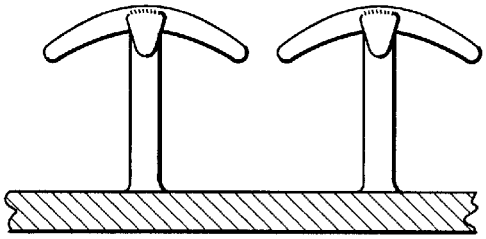
Figure 7:
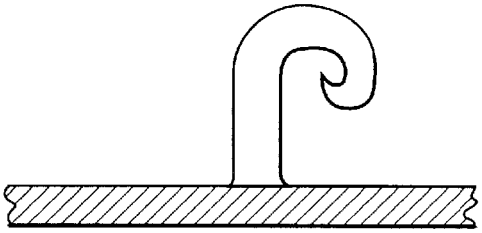
Figure 8:
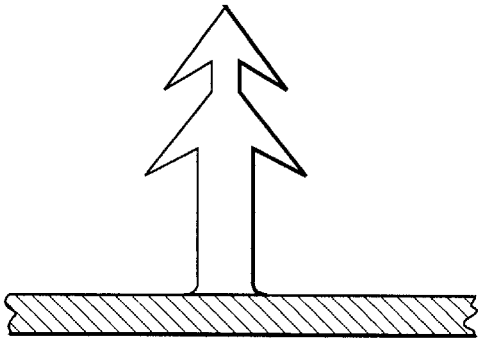

If the core fabric is made by weaving or knitting, of which one example 14 is shown in FIG. 4, then the weave or knit pattern, yarn type, and yarn size are chosen to provide a core fabric with the desired porosity and physical properties. A perforation step is then not necessary. Several methods are known whereby hook structures 11 can be incorporated into either, or both, surfaces of a woven or knitted fabric.

The core fabric also includes the hook means, which either are formed integrally with it during an extrusion step, are woven into it during a weaving step, or are knitted into it during a knitting step. In each case, the size, shape, and location of the multiplicity of hook means is chosen to allow sufficient, preferably optimum, entanglement of the hook means with the pre-needled batt layer. The hook shape may be chosen from a variety of shapes, such as those known as mushroom, "palm tree", fish hook, and "Christmas Tree", as shown in FIGS. 5–8. Other structures are possible, and furthermore a core fabric does not have to have the same, or the same size, hook structures on both sides, especially if the two applied pre-needled nonwoven fibrous batt layers are not the same thickness. The only limitations on hook means size and shape are first that a given hook means provides adequate and secure engagement by entanglement with the batt fibers, and second that the hook means can be created on the surface of the core fabric. For example, in order to achieve adequate entanglement, the hook means has to project an adequate amount above the surface of the core fabric. With certain hook means shapes entanglement of the hook means into the batt can be improved by the choice of a size and shape that will entangle the batt fibers sufficiently under low pressure, and that will deform or crush to entangle the batt fibers more tightly under the higher load pressures imposed during use of the fabric, for example the compressive loads imposed on a press fabric by the press rolls.

The preneedled nonwoven fibrous batt 11 layer is generally made by needling together thinner layers of lightly entangled carded fibers until a desired batt density is reached. The batt fiber dimension and compositions are also chosen to optimize batt properties.

The made up pre-needled nonwoven fibrous batt can be attached to the core fabric in one of several ways. Strips of pre-needled batt material may be laid over the core fabric so that a majority of their component fibers are oriented in a particular direction. For example, in a press fabric the batt fibers can be oriented substantially parallel to the direction of movement in the press section, so that they are in the machine direction. Alternatively, the strips may be laid so that a majority of the batt fibers are substantially perpendicular to this direction so that they are in the cross machine direction. Preferably, the batt is positioned so that its fibers are generally oriented in the machine direction. It is a requirement of this invention that the batt be pre-needled to the necessary size and density required by the intended end use prior to attachment to the core fabric, thus avoiding any damage to the core fabric by the batt needling step.

If the core fabric is an extruded material, the hooks can be located in substantially parallel rows. Depending on the hook structure, it is possible to orient the hooks substantially perpendicularly to the direction of the rows. For example, in a pres fabric, the rows are advantageously located substantially in the machine direction, and the hook means in the cross machine direction. In such a press fabric it is preferred that the batt be oriented so that its component fibers are also generally oriented in the machine direction.

When two fibrous batts are required, one on each surface of the core fabric, there are several ways in which the core fabric can be made. It can be made as two separate layers each having hook means on one surface, which are then attached together by any suitable means, such as by gluing to provide a double sided core fabric. Alternatively, the core fabric can be woven or extruded as a double sided fabric having the required hook means on both surfaces. It is preferred that double sided core fabrics are made by extrusion.

The porous fabrics of this invention may be assembled as follows. First, the core fabric is assembled to provide the required size of the finished press fabric. Strips of the nonwoven fibrous batt are then laid over the hook means and lightly pressed onto them by any suitable method, so as to entangle the hook means with the batt fibers. This relatively simple step provides a porous fabric in which the pre-needled nonwoven fibrous batt is attached sufficiently securely to the core fabric to permit handling and installation of the fabric. Alternatively, for a closed loop porous fabric, such as is used in a press section, it can be conveniently assembled from a core fabric in the form of a relatively narrow strip by a modification of the spiral winding method described by Best in U.S. Pat. No. 5,268,076 and by Rexfelt et al. in U.S. Pat. No. 5,360,656.

When a fabric according to this invention is used under circumstances that involve the repetitive application of a level of compressive load to the multilayer porous fabric, for example when installed in the press section of a papermaking machine, the hook means which have been initially lightly pressed into entanglement with the nonwoven batt will become progressively more firmly entangled into the batt as the fabric cycles through the compressive loads. After only a few cycles, it will become effectively impossible to remove the pre-needled nonwoven fibrous batt from the core fabric without destroying the multilayer porous fabric.

Experimental Trial

In a laboratory scale trial, a length of Aplix type 917 hook material, available from Aplix of Charlotte, N.C. was used as the core fabric. This fabric is an extruded material, which is smooth on one side and is provided with "Christmas tree" type hooks on the other. Two strips of this material were glued together back-to-back to form the core fabric. A pre-needled, nonwoven fibrous standard Meridian (trade mark) 28 dtex batt (available from JWI Group Press Fabric Division, of Jonesboro, Ga., USA) was attached to the core fabric by lightly pressing the two fabrics together. The composite structure was then run through 460,000 cycles on a laboratory scale two roll press so as to simulate the pressures and conditions found in the press section of a papermaking machine. Following the test run, the fabric was in very good condition and there was no evidence of batt delamination. Inspection of the fabric also showed that a large proportion of the hooks in the base substructure were collapsed, securely anchoring the batt fibers.

By means of this invention, it is no longer necessary for a multilayer porous fabric manufacturer to needle a batt onto a core fabric. Instead, a woven or nonwoven core fabric is used which includes hook means on one or both of its surfaces, to which a pre-needled nonwoven fibrous batt is attached simply by pressing the batt and the core fabric together. Generally, the hook means will be provided in parallel rows, although this is not necessary.

We claim:

1. A multilayer porous fabric structure comprising in combination a porous core fabric including a plurality of hook means on at least one of its surfaces, and at least one layer of pre-needled nonwoven fibrous batt, wherein at least some of the batt fibers are entangled onto the hook means.

2. A fabric according to claim 1 wherein the porous core fabric is a woven, knitted or extruded fabric.

3. A fabric according to claim 2 wherein the porous core fabric is an extruded sheet substantially of the size required for the finished fabric.

4. A fabric according to claim 1 wherein the core fabric is a closed loop comprising a spiral wound strip of suitable width.

5. A fabric according to claim 2 wherein the core fabric is an extruded sheet and includes a plurality of suitably located hook means on at least one of its two surfaces.

6. A fabric according to claim 5 wherein the core fabric is an extruded sheet and includes a plurality of hook means located in spaced rows on at least one of its two surfaces.

7. A fabric according to claim 2 wherein the core fabric is a perforated extruded sheet which includes a plurality of suitably shaped and located apertures.

8. A fabric according to claim 6 wherein in the core fabric is a perforated extruded sheet which includes a plurality of suitably shaped apertures.

9. A fabric according to claim 8 wherein shaped apertures are located in the spaces between the hook means.

10. A fabric according to claim 2 wherein the core fabric is woven to include a plurality of suitably located hook means, and to a weave pattern providing the desired level of porosity.

11. A fabric according to claim 2 wherein the core fabric is knitted to include a plurality of suitably located hook means, and to a knit density providing the desired level of porosity.

12. A fabric according to claim 2 wherein the core fabric is an extruded sheet or strip and includes hook means having a shape chosen from the group consisting of fish hook, mushroom, "Christmas tree", and "palm tree".

13. A fabric according to claim 1 including two layers, comprising a core fabric and a single pre-needled nonwoven fibrous batt layer on one side.

14. A fabric according to claim 1 including three layers, comprising a core fabric and two pre-needled nonwoven fibrous batt layers, one on each side of the core layer.

* * * * *